US011713755B2

(12) United States Patent
Spakowski et al.

(10) Patent No.: US 11,713,755 B2
(45) Date of Patent: Aug. 1, 2023

(54) HIGH-PRESSURE FUEL PUMP

(71) Applicant: DELPHI TECHNOLOGIES IP LIMITED, St. Michael (BB)

(72) Inventors: Joseph G. Spakowski, Rochester, NY (US); Brandon Kaswer, Rochester, NY (US)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 0 days.

(21) Appl. No.: 17/477,737

(22) Filed: Sep. 17, 2021

(65) Prior Publication Data

US 2022/0003233 A1 Jan. 6, 2022

Related U.S. Application Data

(63) Continuation-in-part of application No. 15/205,349, filed on Jul. 8, 2016, now abandoned.

(51) Int. Cl.

| | |
|---|---|
| ***F04B 53/14*** | (2006.01) |
| ***F04B 53/16*** | (2006.01) |
| ***F04B 19/22*** | (2006.01) |
| ***F04B 1/053*** | (2020.01) |
| ***F04B 53/02*** | (2006.01) |

(Continued)

(52) U.S. Cl.

CPC ..... *F04B 53/143* (2013.01); *F02M 59/442* (2013.01); *F04B 1/0408* (2013.01); *F04B 1/0448* (2013.01); *F04B 1/053* (2013.01); *F04B 7/0076* (2013.01); *F04B 19/22* (2013.01); *F04B 53/02* (2013.01); *F04B 53/14* (2013.01); *F04B 53/16* (2013.01)

(58) Field of Classification Search

CPC ..... F02M 59/025; F02M 2200/16; F02M 59/02–102; F04B 1/122; F04B 1/124; F04B 19/22; F04B 9/02–042; F04B 53/143; F04B 53/16

See application file for complete search history.

(56) References Cited

U.S. PATENT DOCUMENTS

| | | | |
|---|---|---|---|
| 2,282,562 | A | 5/1942 | Wheeler |
| 2,569,233 | A | 9/1951 | Dickson et al. |

(Continued)

FOREIGN PATENT DOCUMENTS

| | | | |
|---|---|---|---|
| CN | 102359446 | A | 2/2012 |
| CN | 202883354 | U | 4/2013 |

(Continued)

*Primary Examiner* — Philip E Stimpert

(74) *Attorney, Agent, or Firm* — Joshua M. Haines

(57) ABSTRACT

A fuel pump includes a plunger which reciprocates within a bore of a housing. The plunger extends from a first end proximal to a pumping chamber to a second end distal from the pumping chamber and includes a sealing ring groove between the first end and the second end. The sealing ring groove extends from an upper shoulder proximal to the first end to a lower shoulder distal from the first end and are separated by a first distance. A sealing ring is located within the sealing ring groove and engages the bore in an interference fit. A diametric clearance greater than 12 microns and less than 30 microns is provided between the plunger and the bore such that the diametric clearance extends between the sealing ring groove and the first end for a second distance which is at least four times the first distance.

16 Claims, 4 Drawing Sheets

(51) Int. Cl.

| | |
|---|---|
| ***F04B 1/0408*** | (2020.01) |
| ***F04B 7/00*** | (2006.01) |
| ***F04B 1/0448*** | (2020.01) |
| ***F02M 59/44*** | (2006.01) |

(56) References Cited

U.S. PATENT DOCUMENTS

| | | | | |
|---|---|---|---|---|
| 3,145,629 | A | 8/1964 | Gottsmann | |
| 3,212,785 | A | 10/1965 | Hamm | |
| 4,050,360 | A * | 9/1977 | Powers | F16J 1/02 74/579 E |
| 5,567,134 | A * | 10/1996 | Inoue | F02M 39/02 417/490 |
| 5,682,861 | A | 11/1997 | Stockner et al. | |
| 5,992,768 | A | 11/1999 | Beatty et al. | |
| 5,996,472 | A | 12/1999 | Nguyen et al. | |
| 6,098,519 | A | 8/2000 | Takahashi et al. | |
| 6,112,727 | A | 9/2000 | Cristiani et al. | |
| 6,138,923 | A | 10/2000 | Nakano et al. | |
| 7,150,606 | B2 | 12/2006 | Bonfardeci et al. | |
| 8,573,112 | B2 | 11/2013 | Nakayama et al. | |
| 9,145,860 | B2 | 9/2015 | Usui et al. | |
| 2005/0274360 | A1 | 12/2005 | Mumford et al. | |
| 2007/0289442 | A1 | 12/2007 | Waller et al. | |
| 2008/0224417 | A1 | 9/2008 | Benson et al. | |
| 2015/0233332 | A1 | 8/2015 | Hashida et al. | |
| 2016/0281693 | A1 | 9/2016 | Aritomi et al. | |

FOREIGN PATENT DOCUMENTS

| | | | | |
|---|---|---|---|---|
| DE | 102007057840 | A1 | 6/2009 | |
| DE | 102008010242 | A1 | 8/2009 | |
| DE | 102008010286 | A1 | 8/2009 | |
| DE | 102009028609 | A1 | 2/2011 | |
| DE | 102015120039 | A1 * | 5/2017 | F02M 59/442 |
| DE | 202021103840 | U1 | 8/2021 | |
| EP | 3039282 | B1 | 2/2019 | |
| JP | 2003206825 | A | 7/2003 | |
| JP | 2005133681 | A | 5/2005 | |
| WO | 2011076296 | A1 | 6/2011 | |
| WO | 2012113351 | A1 | 8/2012 | |
| WO | 2015120930 | A1 | 8/2015 | |

* cited by examiner

HIGH-PRESSURE FUEL PUMP

CROSS-REFERENCE TO RELATED APPLICATIONS

This application is a continuation-in-part application of U.S. patent application Ser. No. 15/205,349, filed on Jul. 8, 2016, the entire disclosure of which is hereby incorporated herein by reference in its entirety.

TECHNICAL FIELD OF INVENTION

The present invention relates to a fuel pump, more particularly to a high-pressure fuel pump which provides fuel at high-pressure for injection directly into a combustion chamber of an internal combustion engine, even more particularly to such a fuel pump having a pumping plunger which reciprocates within a plunger bore of a pump housing to pressurize fuel within a pumping chamber defined in the pump housing, and still even more particularly to such a fuel pump in which the pumping plunger includes an annular sealing ring groove and a sealing ring within the sealing ring groove which engages the plunger bore in an interference fit to minimize leakage of fuel between the interface of the pumping plunger and the plunger bore.

BACKGROUND OF INVENTION

Fuel systems for modern internal combustion engines typically employ either 1) port fuel injection (PFI) where fuel is injected into an air intake manifold of the internal combustion engine at relatively low pressure (typically below about 500 kPa) and subsequently passed to the combustion chamber of the internal combustion engine or 2) gasoline direct injection (GDi) where fuel is injected directly into the combustion chamber of the internal combustion engine at relatively high pressure (typically above about 14 MPa). In PFI systems, the fuel is typically pumped from a fuel tank to the internal combustion engine by an electric fuel pump which is located with the fuel tank of the fuel system. However, GDi systems require an additional fuel pump to boost the pressure of the fuel compared to the pressure which can be achieved by the electric fuel pump. In order to elevate the fuel pressure to the magnitude needed for direct injection, it is typical to employ a piston-type high-pressure fuel pump which is driven by a camshaft of the internal combustion engine.

In a typical high-pressure fuel pump, a pump housing defines an inlet, an outlet, a pumping chamber, and a plunger bore which opens into the pumping chamber. A pumping plunger is reciprocated within the plunger bore by a camshaft of the internal combustion engine such that each cycle of the pumping plunger increases and decreases the volume of the pumping chamber. An inlet valve selectively opens when the pumping plunger is moving in a direction which increases the volume of the pumping chamber, i.e. the inlet stroke, thereby allowing low-pressure fuel to enter the pumping chamber. When the pumping plunger is moving in a direction which decreases the volume of the pumping chamber, i.e. the pressure stroke, fuel within the pumping chamber is elevated in pressure as a result of the decreased volume. When the pressure of the fuel within the pumping chamber reaches a predetermined threshold, an outlet valve opens, thereby allowing high-pressure fuel to be discharged from the outlet. An example of such a high-pressure fuel pump is disclosed in U.S. Pat. No. 8,573,112 to Nakayama et al. which is hereinafter referred to as Nakayama et al. and which is incorporated herein by reference in its entirety.

In order to allow for efficient operation of a high-pressure fuel pump as described above, it is necessary to minimize leakage between the pumping plunger and the plunger bore. Minimization of leakage between the pumping plunger and the plunger bore is typically dealt with by providing a close clearance between the pumping plunger and the plunger bore. In order to keep leakage at an acceptable level, the clearance is less than 12 microns, and furthermore, this clearance of 12 microns typically extends for a length that is at least two times the diameter of the pumping plunger. However, it is important that the clearance between the pumping plunger and the plunger bore not be too small because there is a risk that the pumping plunger could seize within the plunger bore during operation due to heat generated by operation of the high-pressure pump causing the pumping plunger to expand radially outward to a greater extent than the plunger bore expands, due to poor lubrication as a result of insufficient clearance for fuel between the pumping plunger and the plunger bore, and due to side load effects on the pumping plunger. As a result, a clearance of 11 microns plus or minus 1 micron may be a typical acceptable tolerance in the manufacture of the pumping plunger and the plunger bore. Such a tolerance is costly to implement and may require match honing between the pumping plunger and the plunger bore, thereby adding time and complexity to the manufacturing process. Furthermore, such a tolerance may require that the pump be increased in fuel pumping capacity to accommodate the low efficiency that is experienced, particularly at low-speed operation of the internal combustion engine.

What is needed is a high-pressure fuel pump which minimizes or eliminates one or more of the shortcomings as set forth above.

SUMMARY OF THE INVENTION

Briefly described, a high-pressure fuel pump includes a pump housing which defines a pumping chamber, a fuel inlet which allows low-pressure fuel into the pumping chamber, a fuel outlet which allows high-pressure fuel out of the pumping chamber, and a plunger bore which extends along an axis and opens into the pumping chamber; a pumping plunger which reciprocates within the plunger bore along the axis such that reciprocation of the pumping plunger within the plunger bore increases and decreases a volume of the pumping chamber, low-pressure fuel flows from the fuel inlet to the pumping chamber when the volume increases, and high-pressure fuel is discharged from the pumping chamber through the fuel outlet when the volume decreases, the pumping plunger extending along the axis from a first end, which is proximal to the pumping chamber, to a second end, which is distal from the pumping chamber, the pumping plunger including a sealing ring groove which is annular in shape and which is located between the first end and the second end such that the sealing ring groove extends along the axis from an upper shoulder, which is proximal to the first end, to a lower shoulder, which is distal from the first end, and such that the upper shoulder and the lower shoulder are separated by a first distance in a direction parallel to the axis; and a sealing ring which is annular in shape and which is located within the sealing ring groove such that the sealing ring engages the plunger bore in an interference fit. A diametric clearance greater than 12 microns and less than 30 microns is provided between the pumping plunger and the plunger bore such that the diametric clearance extends between the sealing ring groove and the first end for a second distance which is at least four times the first distance. The high-pressure fuel pump as described herein provides for increased pumping efficiency while increasing service life of the sealing ring and minimizing manufacturing costs by increasing the diametric clearance between the pumping plunger and the plunger bore. Increasing the diametric clearance also minimizes the likelihood of binding between the pumping plunger and the plunger bore during operation.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
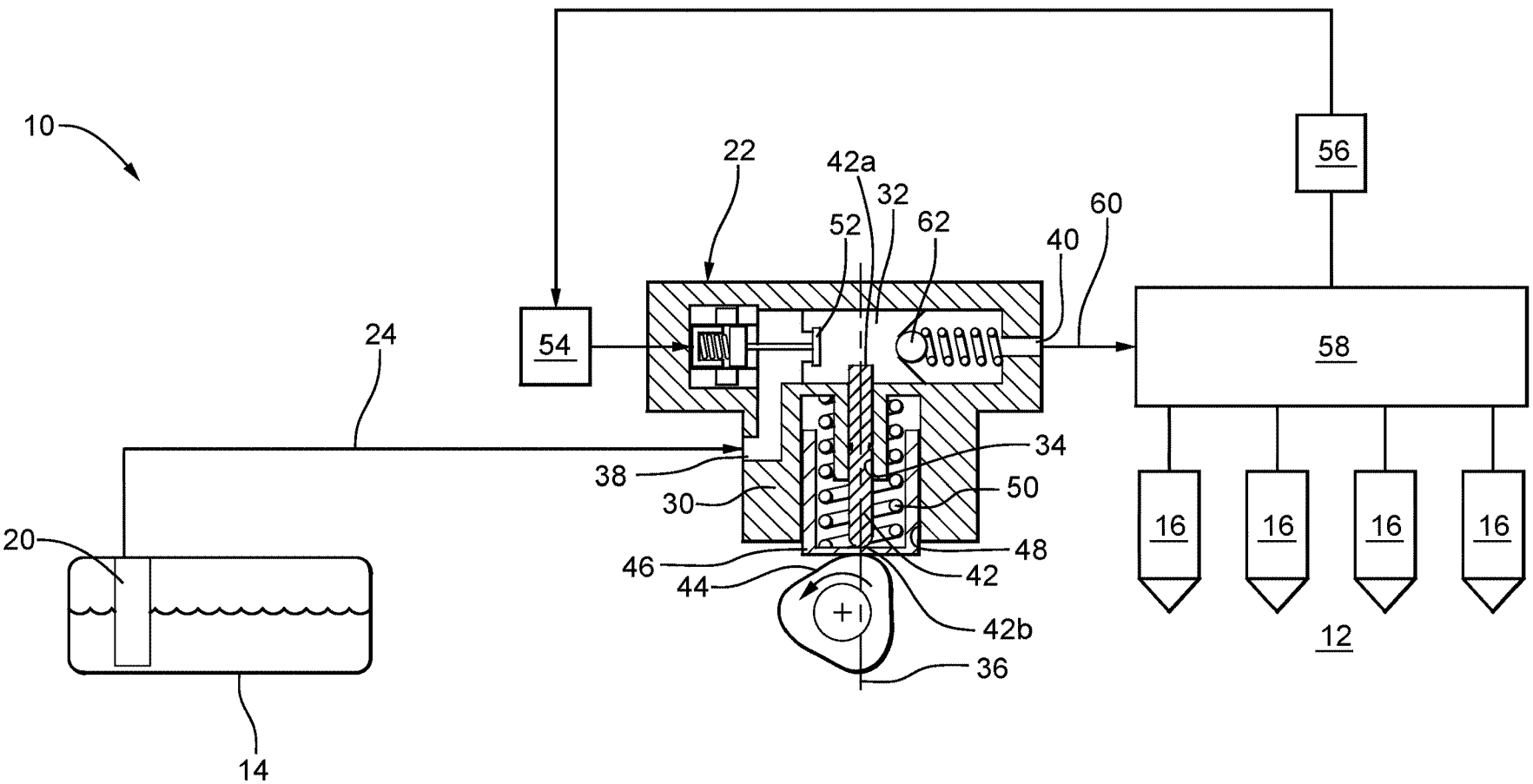
FIG. 1 is a view of a fuel system including a high-pressure fuel pump in accordance with the present invention.

In accordance with a preferred embodiment of this invention and referring to FIG. 1, a fuel system 10 for an internal combustion engine 12 is shown. Fuel system 10 generally includes a fuel tank 14 which holds a volume of fuel to be supplied to internal combustion engine 12 for operation thereof; a plurality of high-pressure fuel injectors 16 which inject fuel directly into respective combustion chambers (not shown) of internal combustion engine 12; a low-pressure fuel pump 20; and a high-pressure fuel pump 22 where the low-pressure fuel pump 20 draws fuel from fuel tank 14 and elevates the pressure of the fuel for delivery to high-pressure fuel pump 22 where high-pressure fuel pump 22 further elevates the pressure of the fuel for delivery to high-pressure fuel injectors 16. By way of non-limiting example only, low-pressure fuel pump 20 may elevate the pressure of the fuel to about 500 kPa or less and high-pressure fuel pump 22 may elevate the pressure of the fuel to above about 14 MPa where pressures on the order of 40 MPa and above are anticipated. While four high-pressure fuel injectors 16 have been illustrated, it should be understood that a lesser or greater number of high-pressure fuel injectors 16 may be provided. As shown, low-pressure fuel pump 20 may be provided within fuel tank 14, however low-pressure fuel pump 20 may alternatively be provided outside of fuel tank 14. Low-pressure fuel pump 20 may be an electric fuel pump. A low-pressure fuel supply passage 24 provides fluid communication from low-pressure fuel pump 20 to high-pressure fuel pump 22. High-pressure fuel pump 22 will be described in greater detail in the paragraphs that follow.

High-pressure fuel pump 22 includes a pump housing 30 which defines a pumping chamber 32 and a plunger bore 34 which opens into pumping chamber 32 such that plunger bore 34 extends along an axis 36. Pump housing 30 also includes a fuel inlet 38 in fluid communication with low-pressure fuel supply passage 24 such that fuel inlet 38 selectively allows low-pressure fuel from low-pressure fuel pump 20 to enter pumping chamber 32 as will be described in greater detail later. Pump housing 30 also defines a fuel outlet 40 which selectively allows high-pressure fuel to exit pumping chamber 32 as will be described in greater detail later. While pump housing 30 has been illustrated schematically as single-piece construction, it should be understood that pump housing 30 may comprise two or more pieces which are joined together to provide the features described herein, by way of non-limiting example only, a tubular insert may be provided within pump housing 30 such that the tubular insert defines plunger bore 34 or fuel inlet 38 may be provided as a feature of a pulsation damper cup (not shown) which houses a pulsation damper (also not show) for minimizing pressure pulsation in the fuel generated during operation.

High-pressure fuel pump 22 also includes a pumping plunger 42 located within plunger bore 34 such that pumping plunger 42 reciprocates within plunger bore 34 along axis 36. Pumping plunger 42 is reciprocated within plunger bore 34, by way of non-limiting example only, by a camshaft 44 of internal combustion engine 12. Pumping plunger 42 is attached to (in contact with) a cam follower 46 which follows the profile of camshaft 44. Cam follower 46 is axially guided within a cam follower bore 48 of pump housing 30 such that a return spring 50 is compressed axially between pump housing 30 and cam follower 46 to maintain cam follower 46 in contact with camshaft 44 as camshaft 44 rotates. While cam follower 46 has been embodied as being guided within cam follower bore 48 of pump housing 30, it should now be understood that cam follower 46 may alternatively be guided within a bore of internal combustion engine 12 that is not within pump housing 30. When camshaft 44, cam follower 46, and return spring 50 cause pumping plunger 42 to move downward as viewed in the figures, the volume of pumping chamber 32 is increased, thereby resulting in an inlet stroke. Conversely, when camshaft 44 and cam follower 46 cause pumping plunger 42 to move upward as viewed in the figures, the volume of pumping chamber 32 is decreased, thereby resulting in a pressure stroke. While not shown, it should be understood that a low-pressure seal may be provided to prevent fuel, that has leaked past the clearance between pumping plunger 42 and plunger bore 34, from mixing with oil that lubricates internal combustion engine 12. One arrangement of such a low-pressure seal is illustrated by Nakayama et al. which was previously referenced above.

High-pressure fuel pump 22 also includes an inlet valve 52 which selectively opens to permit fuel to enter pumping chamber 32 from low-pressure fuel supply passage 24. Inlet valve 52 may be, by way of non-limiting example only, a solenoid operated valve which is controlled by a controller 54. Controller 54 may receive input from a pressure sensor 56 which supplies a signal indicative of the pressure of the fuel being supplied to high-pressure fuel injectors 16. As illustrated, a pressure sensor 56 may arranged to read the fuel pressure within a high-pressure fuel rail 58 which receives high-pressure fuel from fuel outlet 40 through a high-pressure fuel supply passage 60 such that high-pressure fuel rail 58 distributes high-pressure fuel to each of high-pressure fuel injectors 16. However, it should be understood that pressure sensor 56 may be positioned at other locations that are indicative of the pressure of the fuel being supplied to high-pressure fuel injectors 16. Controller 54 sends signals to inlet valve 52 to open and close inlet valve 52 as necessary to achieve a desired fuel pressure at pressure sensor 56 as may be determined by current and anticipated engine operating demands. When inlet valve 52 is opened while pumping plunger 42 is moving to increase the volume of pumping chamber 32, i.e. when inlet valve 52 is moving downward as viewed in the figures, fuel from low-pressure fuel supply passage 24 is allowed to flow into pumping chamber 32 through fuel inlet 38.

High-pressure fuel pump 22 also includes an outlet valve 62 which selectively opens to permit fuel to exit pumping chamber 32 to high-pressure fuel supply passage 60. Outlet valve 62 may be a spring-biased valve which opens when the pressure differential between pumping chamber 32 and high-pressure fuel supply passage 60 is greater than a predetermined threshold. Consequently, when camshaft 44 and cam follower 46 cause pumping plunger 42 to decrease the volume of pumping chamber 32, the fuel within pumping chamber 32 is pressurized. Furthermore, when the pressure within pumping chamber 32 is sufficiently high, outlet valve 62 is urged open by the fuel pressure, thereby causing pressurized fuel to be supplied to high-pressure fuel injectors 16 through fuel outlet 40, high-pressure fuel supply passage 60, and high-pressure fuel rail 58.

Additional reference will now be made to FIG. 2 which shows an enlarged portion of FIG. 1, more particularly, an enlarged portion showing portions of pump housing 30 and pumping plunger 42. Additional reference will now also be made to FIG. 3 which shows an enlarged portion of FIG. 2. In order to improve efficiency, particularly at low rotational speeds of camshaft 44 caused by low operating speeds of internal combustion engine 12, and to permit greater annular clearance between pumping plunger 42 and plunger bore 34, pumping plunger 42, which is cylindrical, is provided with a sealing ring groove 64 within which is located a sealing ring 66. Pumping plunger 42 extends along axis 36 from a first end 42*a*, which is proximal to pumping chamber 32, to a second end 42*b*, which is distal from pumping chamber 32. Sealing ring groove 64 is annular in shape and concentric with pumping plunger 42 and plunger bore 34 such that sealing ring groove 64 extends radially inward from the outer periphery of pumping plunger 42 and such that sealing ring groove 64 is located between first end 42*a* and second end 42*b*. Sealing ring groove 64 extends along axis 36 from an upper shoulder 64*a*, which is proximal to first end 42*a*, to a lower shoulder 64*b*, which is distal from first end 42*a* such that upper shoulder 64*a* and lower shoulder 64*b* are separated from each other by a first distance 68 in a direction parallel to axis 36. Upper shoulder 64*a* and lower shoulder 64*b* are both transverse to axis 36 and may be perpendicular to axis 36 as illustrated in the figures. It should be noted that a chamfer or radius may join upper shoulder 64*a* with the outer periphery of pumping plunger 42 where this chamfer or radius is considered to be a portion of sealing ring groove 64. Similarly, a chamfer or radius may join lower shoulder 64*b* with the outer periphery of pumping plunger 42 where this chamfer or radius is considered to be a portion of sealing ring groove 64.

A diametric clearance 69, i.e. diameter of plunger bore 34 minus diameter of pumping plunger 42, between pumping plunger 42 and plunger bore 34 is greater than 12 microns and less than 30 microns such that a portion of diametric clearance 69 is located between sealing ring groove 64 and first end 42*a* and extends for a second distance 70 which is at least four times first distance 68, and preferably at least eight times first distance 68, and such that another portion of diametric clearance 69 is located between sealing ring groove 64 and second end 42*b* and extends for a third distance 72 which is at least two times first distance 68 and is preferably at least four times first distance 68. As illustrated in the figures, the portion of diametric clearance 69 that is located between sealing ring groove 64 and first end 42*a* may be continuous, however, may alternatively be discontinuous. Similarly, the portion of diametric clearance 69 that is located between sealing ring groove 64 and second end 42*b* may be continuous, however, may alternatively be discontinuous. By having second distance 70 be at least four times first distance 68 and preferably eight times first distance 68, the portion of diametric clearance 69 which extends over second distance 70 provides a pressure drop to the fuel such that sealing ring 66 is not subjected to the full pressure experienced within pumping chamber 32, thereby increasing the service life of sealing ring 66. Furthermore, by having second distance 70 be at least four times first distance 68, and preferably eight times first distance 68, and by having third distance 72 be at least two times first distance 68, and preferably at least four times first distance 68, tilting of pumping plunger 42 is minimized which allows for a more reliable sealing contact between sealing ring 66 and plunger bore 34, thereby improving pumping efficiency and durability of sealing ring 66.

Sealing ring 66 extends in a direction parallel to axis 36 for a fourth distance 74 from an upper surface 66*a*, which is proximal to upper shoulder 64*a*, to a lower surface 66*b*, which is distal from upper shoulder 64*a* such that fourth distance 74 is in a range of 80% to 90% of first distance 68. It should be noted that fourth distance 74 is in a range of 80% to 90% when sealing ring 66 is installed within sealing ring groove 64 and is compressed both radially outward by pumping plunger 42 and radially inward by plunger bore 34, and consequently, provides an axial clearance 76 between upper shoulder 64*a* and upper surface 66*a*. Axial clearance 76 allows pressurized fuel to be distributed across the entirety of upper surface 66*a* during operation which causes sealing ring 66 to try to expand both radially inward and radially outward, thereby increasing the contact force against pumping plunger 42 and against plunger bore 34 and increasing sealing effect therebetween. Sealing ring 66 extends in a direction radially relative to axis 36 from an inner peripheral surface 66*c*, which engages pumping plunger 42, to an outer peripheral surface 66*d*, which engages plunger bore 34. Sealing ring 66 includes a first chamfer 66*e* which connects outer peripheral surface 66*d* to upper surface 66*a* and also includes a second chamfer 66*f* which connects outer peripheral surface 66*d* to lower surface 66*b*.

Sealing ring 66 is made of a polymer material such that the polymer material extends from inner peripheral surface 66*c* to outer peripheral surface 66*d* and is preferably made of PTFE (polytetrafluoroethylene) due to low friction and fuel resistant properties. While PTFE may be preferable, other polymer materials may be substituted. During installation, sealing ring 66 is elastically stretched over pumping plunger 42 and slid on the outer periphery of pumping plunger 42 until sealing ring 66 is aligned with sealing ring groove 64. After sealing ring 66 is aligned with sealing ring groove 64, sealing ring 66 retracts into sealing ring groove 64. Sealing ring 66 is sized to engage plunger bore 34 in an interference fit. First chamfer 66*e* and second chamfer 66*f* ease insertion of sealing ring 66 into plunger bore 34 while allowing sealing ring 66 to remain symmetrical, thereby eliminating the need for specific orientation of sealing ring 66 when being assembled into sealing ring groove 64. Preferably, diametric clearance 69 between pumping plunger 42 and plunger bore 34 is in the range of 13 microns to 30 microns. Since sealing ring 66 engages plunger bore 34 in an interference fit, diametric clearance 69 between pumping plunger 42 and plunger bore 34 is greater than 12 microns, thereby eliminating the need to match hone pumping plunger 42 and plunger bore 34.

Furthermore, sealing ring 66 engaging plunger bore 34 in an interference fit increases the efficiency of high-pressure fuel pump 22, particularly at low rotational rates of camshaft 44, by minimizing fuel leakage between pumping plunger 42 and plunger bore 34. Sealing ring 66 is also sized such that when pumping plunger 42 with sealing ring 66 is installed within plunger bore 34, sealing ring 66 is held in radial compression between plunger bore 34 and pumping plunger 42. Another added benefit of pumping plunger 42 including sealing ring 66 is that the risk of pumping plunger 42 seizing within plunger bore 34 is minimized because the clearance between pumping plunger 42 and plunger bore 34 can be increased to an extent such that thermal expansion of pumping plunger 42 in use will not be sufficient to bind pumping plunger 42 within plunger bore 34.

It is important to note that Nakayama et al., which was introduced above in the Background of Invention section, discloses a seal system, identified by reference number 21 in Nakayama et al., which maintains separation between gasoline and engine oil. However, the seal system of Nakayama et al., unlike sealing ring 66 of the present invention, does nothing to improve the efficiency of the fuel pump because the seal system of Nakayama et al. is on the low-pressure side of the interface of the pumping plunger and the plunger bore. Consequently, the efficiency of the fuel pump of Nakayama et al. is dependent upon the clearance between the pumping plunger and the plunger bore.

In operation, during the inlet stroke, inlet valve 52 is opened to allow fuel to flow into pumping chamber 32 from fuel inlet 38 as pumping plunger 42 is increasing the volume of pumping chamber 32 as a result of camshaft 44 and return spring 50. Inlet valve 52 may remain open during the inlet stroke for a period of time, determined by controller 54, which is sufficient to allow a volume of fuel into pumping chamber 32 that will satisfy the fueling needs of internal combustion engine 12. During the pressure stroke, when inlet valve 52 is closed, pumping plunger 42 decreases the volume of pumping chamber 32 as a result of camshaft 44. Decreasing the volume of pumping chamber 32 results in increasing the pressure of the fuel within pumping chamber 32 where the high-pressure fuel is contained within pumping chamber 32, in part, by the interference fit between sealing ring 66 and plunger bore 34. When the pressure within pumping chamber 32 is sufficiently high, outlet valve 62 is opened, thereby allowing high-pressure fuel to exit pumping chamber 32 through fuel outlet 40 and to be communicated to high-pressure fuel rail 58.

Figure 2:
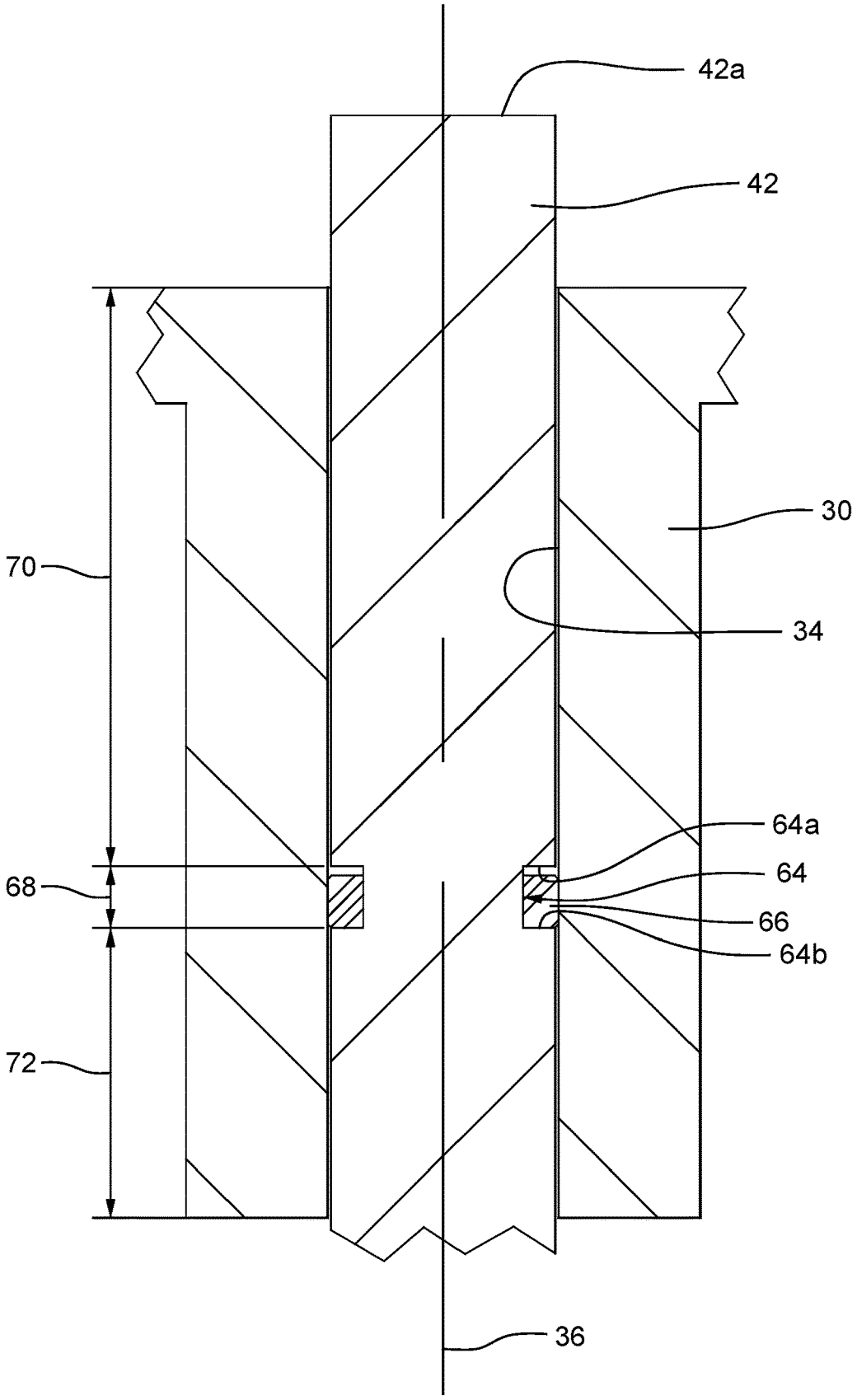
FIG. 2 is an enlarged view of a portion of FIG. 1 showing a portion of a pumping plunger within a respective plunger bore of a pump housing.
Figure 3:
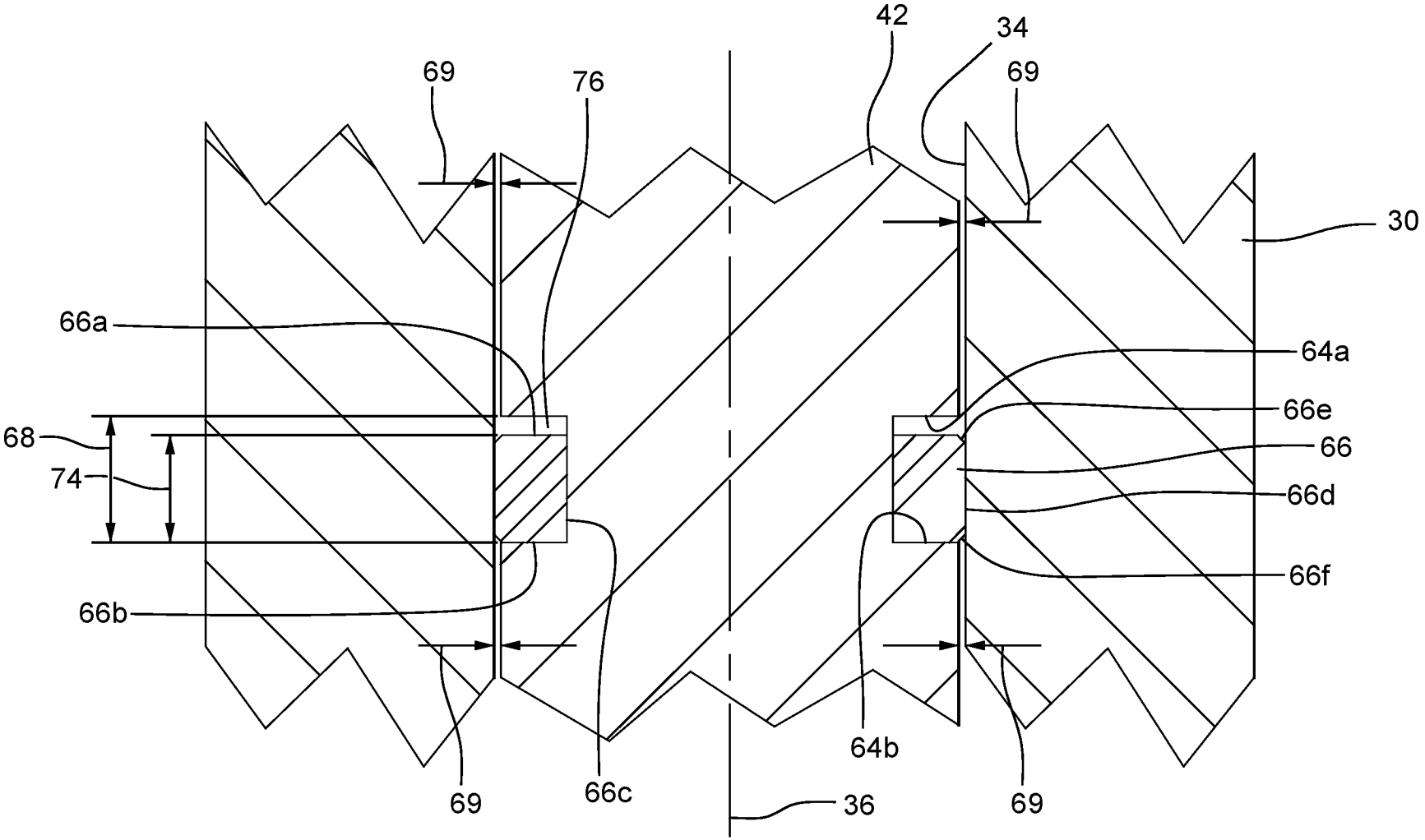
FIG. 3 is an enlarged view of a portion of FIG. 2.
Figure 4:
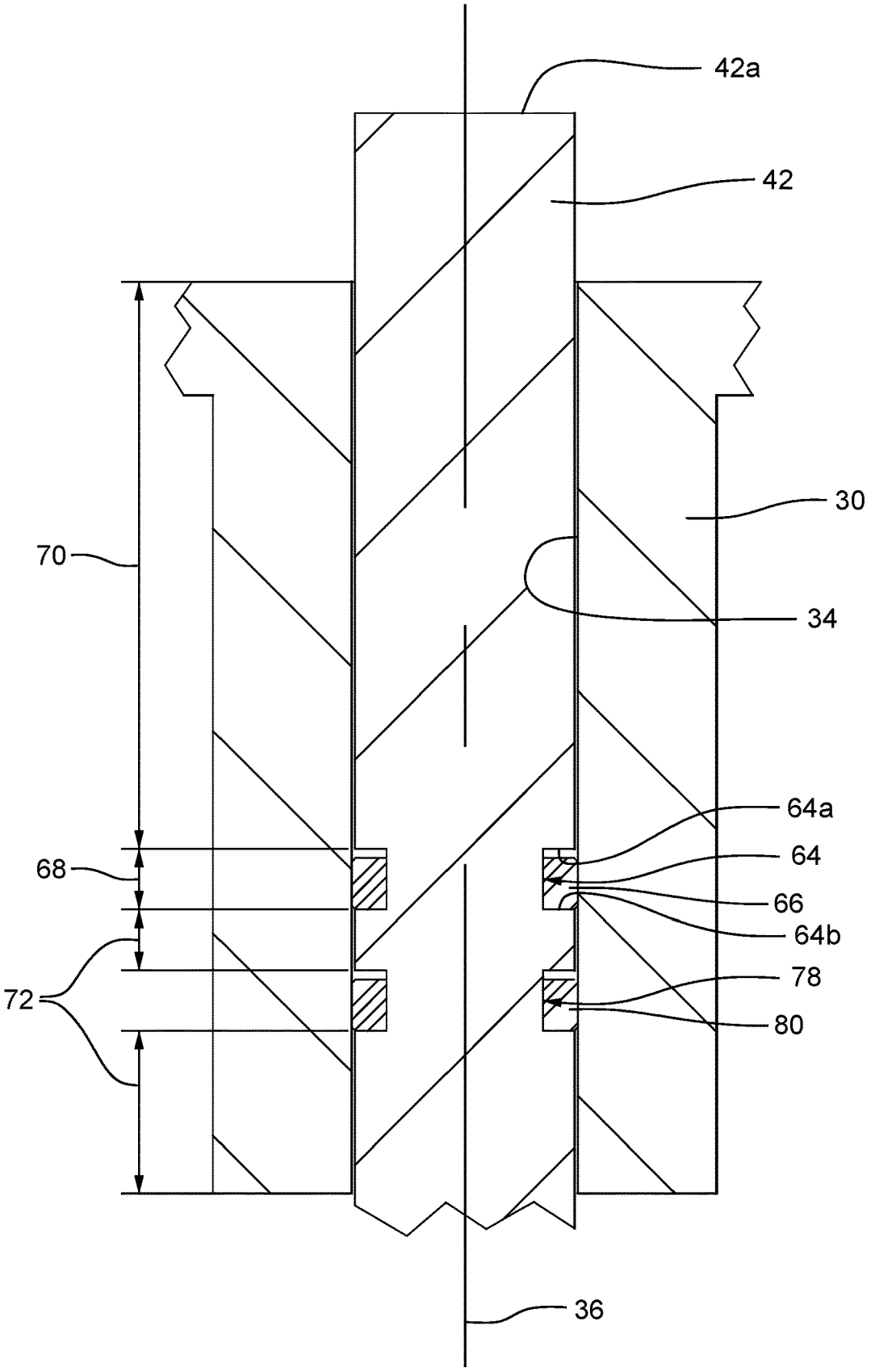
FIG. 4 is the view of FIG. 2 showing a variation of the pumping plunger.

In a variation of FIGS. 1-3, FIG. 4 shows that pumping plunger 42 may include sealing ring groove 78 containing sealing ring 80 in addition to sealing ring groove 64 and sealing ring 66. Sealing ring groove 78 is the same as sealing ring groove 64, and consequently, the previous description of sealing ring groove 64 applies equally to sealing ring groove 78. Similarly, sealing ring 80 is the same as sealing ring 66, and consequently, the previous description of sealing ring 66 applies equally to sealing ring 80. As can be seen in FIG. 4, third distance 72 of diametric clearance 69 is segmented into two sections by sealing ring groove 78. As a result, third distance 72 of diametric clearance 69 is the sum of these two segments, i.e. between sealing ring groove 64 and sealing ring groove 78 and between sealing ring groove 78 and second end 42*b*. However, the sum of these two segments is still at least two times first distance 68 and is preferably at least four times first distance 68 just as previously described when only sealing ring groove 64 and sealing 66 are included as shown in FIGS. 1-3. It should now be understood that additional sealing ring grooves and sealing rings may also be included. Regardless of how many sealing rings are provided, their placement and spacing on pumping plunger 42 is provided such that the sealing rings do not leave plunger bore 34 throughout the range of motion of pumping plunger 42.

As should now be readily apparent, the inclusion of sealing ring groove 64 and sealing ring 66, and optionally sealing ring groove 78 and sealing ring 80, provides for greater efficiency of high-pressure fuel pump 22. In one test that was conducted on high-pressure fuel pumps that were otherwise the same, inclusion of sealing ring groove 64 and sealing ring 66 provided increased efficiency at all operational speeds of the high-pressure fuel pumps, with a particularly significant increase in efficiency at lower operating speeds. This increase in efficiency may allow for high-pressure fuel pump 22 to be downsized in fuel pumping capacity, thereby reducing the cost of high-pressure fuel pump 22, since high-pressure fuel pump 22 does not need to accommodate a loss in efficiency, particularly at low operational speeds of internal combustion engine 12. Downsizing the fuel pumping capacity of high-pressure fuel pump 22, for example by decreasing the diameter of pumping plunger 42, is important because emission regulations are continually being made more stringent and the desire to provide fuel at higher pressure is more desirable to better atomize the fuel which is beneficial for reducing emissions of internal combustion engine 12. Decreasing the diameter of pumping plunger 42 is a way to limit excessive loads on the valve train of internal combustion engine 12, but this can only be done if the efficiency of high-pressure fuel pump 22 is improved at higher pressures. A further benefit of sealing ring groove 64 and sealing ring 66 is that the clearance between pumping plunger 42 and plunger bore 34 is able to be increased, thereby eliminating the need for time consuming and costly manufacturing techniques such as match honing of pumping plunger 42 and plunger bore 34. As described herein, the relationship between first distance 68, i.e. of sealing ring groove 64, second distance 70, i.e. of diametric clearance 69, third distance 72, i.e. of diametric clearance 69, and fourth distance 74, i.e. of sealing ring 66, pumping efficiency can be maximized while increasing the service life of sealing ring 66.

While this invention has been described in terms of preferred embodiments thereof, it is not intended to be so limited, but rather only to the extent set forth in the claims that follow.

We claim:

1. A high-pressure fuel pump comprising:

a pump housing which defines a pumping chamber, a fuel inlet which allows low-pressure fuel into said pumping chamber, a fuel outlet which allows high-pressure fuel out of said pumping chamber, and a plunger bore which extends along an axis and opens into said pumping chamber;

a pumping plunger which reciprocates within said plunger bore along said axis such that reciprocation of said pumping plunger within said plunger bore increases and decreases a volume of said pumping chamber, low-pressure fuel flows from said fuel inlet to said pumping chamber when said volume increases, and high-pressure fuel is discharged from said pumping chamber through said fuel outlet when said volume decreases, said pumping plunger extending along said axis from a first end, which is proximal to said pumping chamber, to a second end, which is distal from said pumping chamber, said pumping plunger including a sealing ring groove which is annular in shape and which is located between said first end and said second end such that said sealing ring groove extends along said axis from an upper shoulder, which is proximal to said first end, to a lower shoulder, which is distal from said first end, and such that said upper shoulder and said lower shoulder are separated by a first distance in a direction parallel to said axis; and a sealing ring which is annular in shape and which is located within said sealing ring groove such that said sealing ring engages said plunger bore in an interference fit;

wherein a diametric clearance greater than 12 microns and less than 30 microns is provided between said pumping plunger and said plunger bore such that said diametric clearance extends between said sealing ring groove and said first end for a second distance which is at least four times said first distance.

2. A high-pressure fuel pump as in claim 1, wherein said diametric clearance is provided between said pumping plunger and said plunger bore such that said diametric clearance extends between said sealing ring groove and said second end for a third distance which is at least two times said first distance.

3. A high-pressure fuel pump as in claim 2, wherein:

said second distance is at least eight times said first distance; and said third distance is at least four times said first distance.

4. A high-pressure fuel pump as in claim 2, wherein said sealing ring extends in said direction parallel to said axis from an upper surface, which is proximal to said upper shoulder, to a lower surface, which is distal from said upper shoulder, for a fourth distance such that said fourth distance is in a range of 80% to 90% of said first distance.

5. A high-pressure fuel pump as in claim 4, wherein:

said sealing ring extends in a direction radially relative to said axis from an inner peripheral surface, which engages said pumping plunger, to an outer peripheral surface, which engages said plunger bore;

said sealing ring includes a first chamfer which connects said outer peripheral surface to said upper surface; and said sealing ring includes a second chamfer which connects said outer peripheral surface to said lower surface.

6. A high-pressure fuel pump as in claim 5, wherein said sealing ring is made of a polymer material such that said polymer material extends from said inner peripheral surface to said outer peripheral surface.

7. A high-pressure fuel pump as in claim 6, wherein said polymer material comprises PTFE.

8. A high-pressure fuel pump as in claim 1, wherein said second distance is at least eight times said first distance.

9. A high-pressure fuel pump as in claim 1, wherein:

said diametric clearance is provided between said pumping plunger and said plunger bore such that said diametric clearance extends between said sealing ring groove and said second end for a third distance; and said sealing ring extends in said direction parallel to said axis from an upper surface, which is proximal to said upper shoulder, to a lower surface, which is distal from said upper shoulder, for a fourth distance such that said fourth distance is in a range of 80% to 90% of said first distance.

10. A high-pressure fuel pump as in claim 9, wherein:

said sealing ring extends in a direction radially relative to said axis from an inner peripheral surface, which engages said pumping plunger, to an outer peripheral surface, which engages said plunger bore;

said sealing ring includes a first chamfer which connects said outer peripheral surface to said upper surface; and said sealing ring includes a second chamfer which connects said outer peripheral surface to said lower surface.

11. A high-pressure fuel pump as in claim 10, wherein said sealing ring is made of a polymer material such that said polymer material extends from said inner peripheral surface to said outer peripheral surface.

12. A high-pressure fuel pump as in claim 11, wherein said polymer material comprises PTFE.

13. A high-pressure fuel pump as in claim 1, wherein said diametric clearance is greater than 12 microns and is less than 20 microns.

14. A high-pressure fuel pump as in claim 1, wherein said sealing ring is compressed radially inward by said plunger bore and is compressed radially outward by said pumping plunger.

15. A high-pressure fuel pump as in claim 1, wherein:

said sealing ring groove is a first sealing ring groove;

said sealing ring is a first sealing ring;

said pumping plunger includes a second sealing ring groove which is annular in shape and which is located between said first sealing ring groove and said second end; and said high-pressure fuel pump further comprises a second sealing ring which is annular in shape and which is located within said second sealing ring groove such that said second sealing ring engages said plunger bore in an interference fit.

16. A high-pressure fuel pump as in claim 15, wherein said diametric clearance is provided between said pumping plunger and said plunger bore such that said diametric clearance extends between said first sealing ring groove and said second end for a third distance which is at least two times said first distance such that said third distance is segmented by said second sealing ring groove.

* * * * *